US009117585B2

(12) United States Patent
Skinner et al.

(10) Patent No.: US 9,117,585 B2
(45) Date of Patent: Aug. 25, 2015

(54) IGNITION COIL

(71) Applicant: DELPHI TECHNOLOGIES, INC., Troy, MI (US)

(72) Inventors: Albert A. Skinner, Waterford, MI (US); Harry O. Levers, Clarkston, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/943,044

(22) Filed: Jul. 16, 2013

(65) Prior Publication Data

US 2015/0022304 A1 Jan. 22, 2015

(51) Int. Cl.

| | |
|---|---|
| ***H01F 27/29*** | (2006.01) |
| ***H01F 27/02*** | (2006.01) |
| ***H01F 27/28*** | (2006.01) |
| ***F02P 3/04*** | (2006.01) |
| ***F02P 13/00*** | (2006.01) |

(52) U.S. Cl.

CPC . *H01F 27/28* (2013.01); *F02P 3/04* (2013.01); *F02P 13/00* (2013.01); *H01F 27/02* (2013.01); *H01F 27/29* (2013.01)

(58) Field of Classification Search

CPC ..... H01F 27/28; H01F 27/02; H01F 27/29; H01F 27/2828; H01F 38/12; H02P 13/00; H02P 3/04

USPC ..... 336/90, 170, 192, 212, 180, 150

See application file for complete search history.

(56) References Cited

U.S. PATENT DOCUMENTS

| | | | | |
|---|---|---|---|---|
| 5,107,817 | A * | 4/1992 | Dittmann et al. | 123/643 |
| 5,146,905 | A * | 9/1992 | Davis | 123/599 |
| 6,328,025 | B1 * | 12/2001 | Marrs | 123/621 |
| 6,556,118 | B1 | 4/2003 | Skinner | |
| 7,148,780 | B2 | 12/2006 | Skinner et al. | |
| 7,882,828 | B2 | 2/2011 | Skinner et al. | |
| 8,416,039 | B2 * | 4/2013 | Bradfield | 335/126 |
| 2006/0091987 | A1 * | 5/2006 | Skinner et al. | 336/90 |
| 2009/0205621 | A1 | 8/2009 | Skinner et al. | |
| 2012/0299679 | A1 | 11/2012 | Kobayashi et al. | |

* cited by examiner

*Primary Examiner* — Mangtin Lian
(74) *Attorney, Agent, or Firm* — Thomas N. Twomey

(57) ABSTRACT

An ignition coil includes a magnetically-permeable core, a primary winding disposed outward of the core, and a secondary winding disposed outward of the primary winding and inductively coupled to the primary winding. The secondary winding includes a left secondary winding section wound clockwise around the primary winding and a right winding section wound counterclockwise around the primary winding. The left secondary winding section has i) a first left winding end distal from the right winding section and ii) a second left winding end that is proximal to the right winding section. The right secondary winding section has i) a first right winding end distal from the left winding section and ii) a second right winding end that is proximal to the left winding section. The second left winding end and the second right winding end are connected to a terminal.

7 Claims, 2 Drawing Sheets

IGNITION COIL

TECHNICAL FIELD OF INVENTION

The present invention relates to an ignition coil for developing a spark-initiating current for a spark plug; and more particularly to such an ignition coil that is compact in height and minimizes electrical field concentrations at a connection of a secondary winding to a high voltage terminal.

BACKGROUND OF INVENTION

Internal combustion engines that utilize spark ignition combustion processes commonly include an ignition coil that is dedicated to a single spark plug. The ignition coil is used to develop a spark-initiating current that is sent to the spark plug, thereby allowing the spark plug to generate a spark which initiates combustion of a fuel and air mixture within a combustion chamber of the internal combustion engine. In one arrangement, as exemplified in United States Patent Application Publication US 2012/0299679 A1 to Kobayashi et al., the ignition coil is arranged to be mounted over an opening which receives the spark plug. The ignition coil of Kobayashi et al. includes a core around which is wound a primary winding. A secondary winding is wound around the primary winding such that a high voltage is induced on the secondary winding when an electric current applied to the primary winding is stopped. A high voltage end of the secondary winding is connected to a high voltage terminal which is in electrical communication with the spark plug, thereby delivering the spark-generating current to the spark plug. In order to facilitate mounting the ignition coil over the opening which receives the spark plug, the high voltage terminal is placed near the middle along the axial length of the secondary winding. Accordingly, the high voltage end of the secondary winding must be routed axially back along the length of the secondary winding as well as radially outward from the secondary winding to reach the high voltage terminal. This routing of the high voltage end of the secondary winding increases the height of the ignition coil, thereby increasing the packaging space needed for the ignition coil. Additionally, the high voltage end of the secondary coil is susceptible to electric field concentrations because it is the furthest point at the end of the secondary winding and is surrounded by surfaces, for example the case of the ignition coil, that are at or near ground potential. Electric field concentrations may be magnified by sharp points, for example, sharp points of solder known as solder icicles formed in the soldering process used to join the end of the secondary winding to the high voltage terminal. These localized occurrences of high electric field concentrations may lead to failure of insulating material, and consequently failure of the ignition coil.

What is needed is an ignition coil which minimizes or eliminates one or more of the shortcomings as set forth above.

SUMMARY OF THE INVENTION

Briefly described, an ignition coil is provided for delivering a spark-generating current to a spark plug. The ignition coil includes a magnetically-permeable core, a primary winding disposed outward of the core, and a secondary winding disposed outward of the primary winding and inductively coupled to the primary winding. The secondary winding includes a left secondary winding section wound clockwise around the primary winding and a right secondary winding section wound counterclockwise around the primary winding. The left secondary winding section has i) a first left winding end distal from the right secondary winding section and ii) a second left winding end that is proximal to the right secondary winding section. The right secondary winding section has i) a first right winding end distal from the left winding section and ii) a second right winding end that is proximal to the left winding section. The second left winding end and the second right winding end are connected to a terminal for delivering the spark-generating current to the spark plug.

BRIEF DESCRIPTION OF DRAWINGS

This invention will be further described with reference to the accompanying drawings in which.

DETAILED DESCRIPTION OF INVENTION

Figure 1:
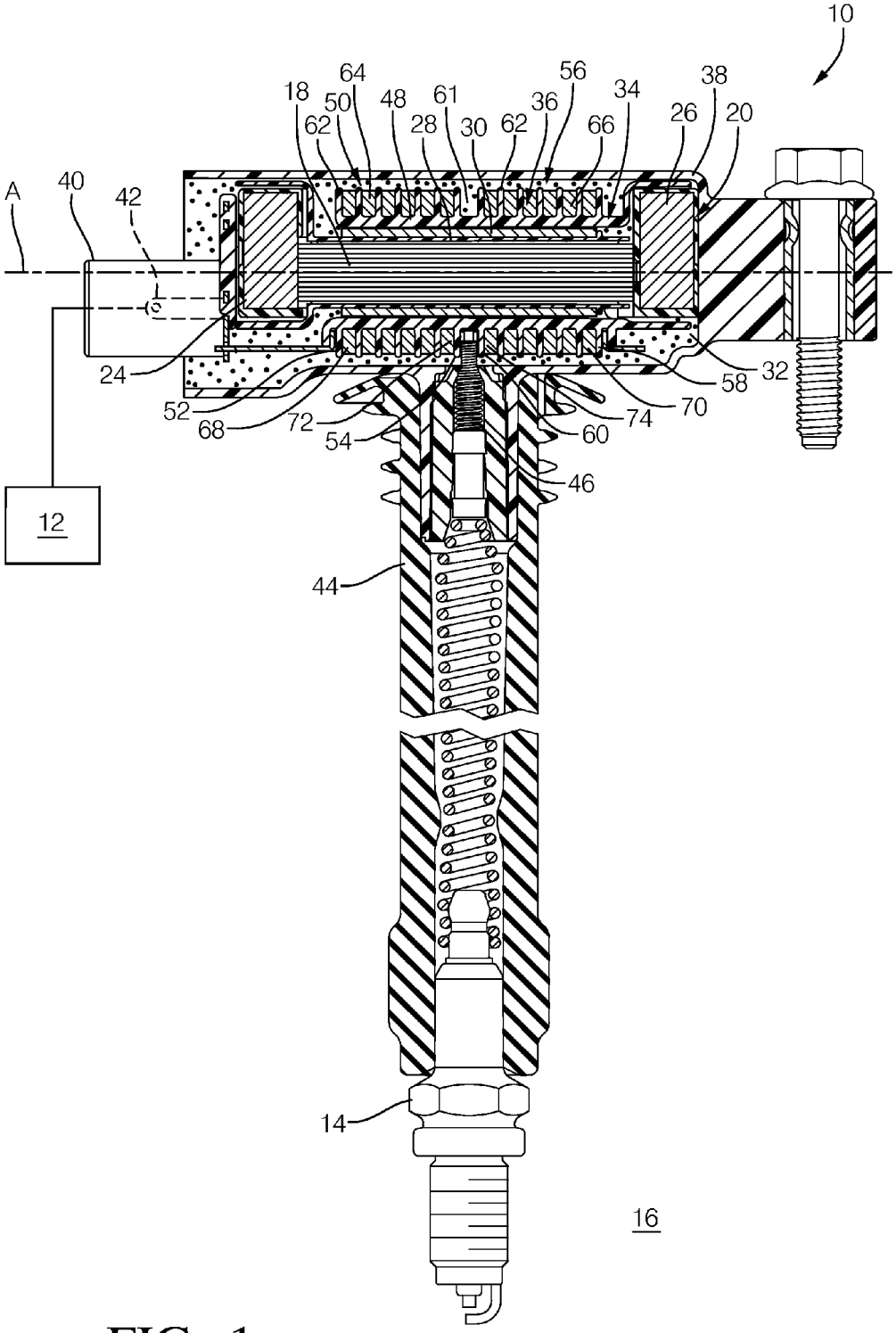
FIG. 1 is a simplified cross-sectional view of an ignition coil in accordance with the present invention.

Referring now to the drawings wherein like reference numerals are used to identify identical components in the various views, FIG. 1 is a simplified cross-section view of an ignition coil 10. Ignition coil 10 may be controlled by a control unit 12 or the like. Ignition coil 10 is configured for connection to a spark plug 14 that is in threaded engagement with a spark plug opening (not shown) in an internal combustion engine 16. Ignition coil 10 is configured to output a high-voltage (HV) output to spark plug 14, as shown. Generally, overall spark timing (dwell control) and the like is provided by control unit 12. Internal combustion engine 16 may include a plurality of spark plugs 14 and one ignition coil 10 may be provided for each spark plug 14.

Ignition coil 10 may include a magnetically-permeable core 18, a magnetically-permeable structure 20 (herein after referred to as high permeance structure 20) configured to provide a high permeance magnetic return path which has a base section 22 (shown in FIG. 2) and a pair of legs 24 and 26, a primary winding spool 28, a primary winding 30, a quantity of encapsulant 32 such as an epoxy potting material, a secondary winding spool 34, a secondary winding 36, a case 38, a low-voltage (LV) connector body 40 having primary terminals 42 (only one primary terminal 42 is visible in FIG. 1 due to being hidden behind one primary terminal 42), and a high-voltage (HV) tower 44 having a high-voltage (HV) terminal 46.

With continued reference to FIG. 1, core 18 extends along a core longitudinal axis A. Core 18 may be made of laminated steel plates, compression molded insulated iron particles, or other appropriate material. Core 18 may be any cross-sectional shape known to those of ordinary skill in the art, for example only, oval or circular.

Primary winding spool 28 is configured to receive and retain primary winding 30. Primary winding spool 28 is disposed adjacent to and radially outward of core 18 and is preferably in coaxial relationship therewith. Primary winding spool 28 may comprise any one of a number of conventional spool configurations known to those of ordinary skill in the art. In the illustrated embodiment, primary winding spool 28 is configured to receive one continuous primary winding. Primary winding spool 28 may be formed generally of electrical insulating material having properties suitable for use in a relatively high temperature environment. For example, primary winding spool 28 may comprise plastic material such as PPO/PS (e.g., NORYL® available from General Electric) or polybutylene terephthalate (PBT) thermoplastic polyester. It should be understood that there are a variety of alternative materials that may be used for primary winding spool 28. Alternatively, but now shown, primary winding spool 28 may be omitted and replaced with an insulating material placed over core 18, for example, a heat shrink material.

Primary winding 30, as described above, is wound onto primary winding spool 28. Primary winding 30 includes first and second ends that are connected to the primary terminals 42 in LV connector body 40. Primary winding 30 is configured to carry a primary current $I_P$ for charging ignition coil 10 upon control of control unit 12. Primary winding 30 may comprise copper, insulated magnet wire, with a size typically between about 20-26 AWG.

Secondary winding spool 34 is configured to receive and retain secondary winding 36. Secondary winding spool 34 is disposed adjacent to and radially outward of the central components comprising core 18, primary winding spool 28, primary winding 30 and, preferably, is in coaxial relationship therewith. Secondary winding spool 34 includes a generally cylindrical body 48 having a left winding bay 50 that is bounded by a first pair of retaining flanges 52, 54. Secondary winding spool 34 also includes a right winding bay 56 that is bounded by a second pair of retaining flanges 58, 60. It should be understood that the terms left and right are only relative to orientation of left winding bay 50 and right winding bay 56 as shown in the figures. Secondary winding spool 34 also includes a termination bay 61 axially between left winding bay 50 and right winding bay 56 such that termination bay 61 is axially between retaining flange 54 and retaining flange 60. In the illustrated embodiment, secondary winding spool 34 is configured for use with a segmented winding strategy where a plurality of axially spaced ribs 62 are disposed between retaining flanges 52, 54 and between retaining flanges 58, 60 to form a plurality of channels therebetween for accepting secondary winding 36. However, it should be understood that other known configurations may be employed, such as, for example only, a configuration adapted to receive one continuous secondary winding in each of left winding bay 50 and right winding bay 56, e.g. progressive winding. Secondary winding spool 34 may be formed generally of electrical insulating material having properties suitable for use in a relatively high temperature environment. For example, secondary winding spool 34 may comprise plastic material such as PPO/PS (e.g., NORYL available from General Electric) or polybutylene terephthalate (PBT) thermoplastic polyester. It should be understood that there are a variety of alternative materials that may be used for secondary winding spool 34.

Secondary winding 36 may be implemented using conventional material (e.g. copper, insulate magnet wire) known to those of ordinary skill in the art. Secondary winding 36 includes a left secondary winding section 64 and a right secondary winding section 66. It should be understood that the terms left and right are only relative to orientation of left secondary winding section 64 and right secondary winding section 66 as shown in the figures. Left secondary winding section 64 is disposed within left winding bay 50 while right secondary winding section 66 is disposed within right winding bay 56. As shown, right secondary winding section 66 is coaxial to left secondary winding section 64 and right secondary winding section 66 is axially spaced from left secondary winding section 64. Left secondary winding section 64 may be wound either clockwise or counterclockwise around secondary winding spool 34 while right secondary winding section 66 is wound in the opposite direction. Left secondary winding section 64 and right secondary winding section 66 may preferably have the same number of windings. Left secondary winding section 64 has a first end 68 that is proximal to retaining flange 52, is connected to ground, and is distal from right secondary winding section 66. Similarly, right secondary winding section 66 has a first end 70 that is proximal to retaining flange 58, is connected to ground, and is distal from left secondary winding section 64. Left secondary winding section 64 and right secondary winding section 66 have second ends 72, 74 respectively which terminate within termination bay 61 and which are connected to HV terminal 46 within termination bay 61, for example, by soldering. It should be understood that left secondary winding section 64 and right secondary winding section 66 may be a single wire or may alternatively be two pieces of wire that are joined within termination bay 61, for example, by soldering.

Encapsulant 32 may be suitable for providing electrical insulation within ignition coil 10. In a preferred embodiment, encapsulant 32 may comprise an epoxy potting material. Sufficient encapsulant 32 is introduced in ignition coil 10, in the illustrated embodiment, to substantially fill the interior of case 38. Encapsulant 32 also provides protection from environmental factors which may be encountered during the service life of ignition coil 10. There are a number of encapsulant materials known in the art.

Figure 2:
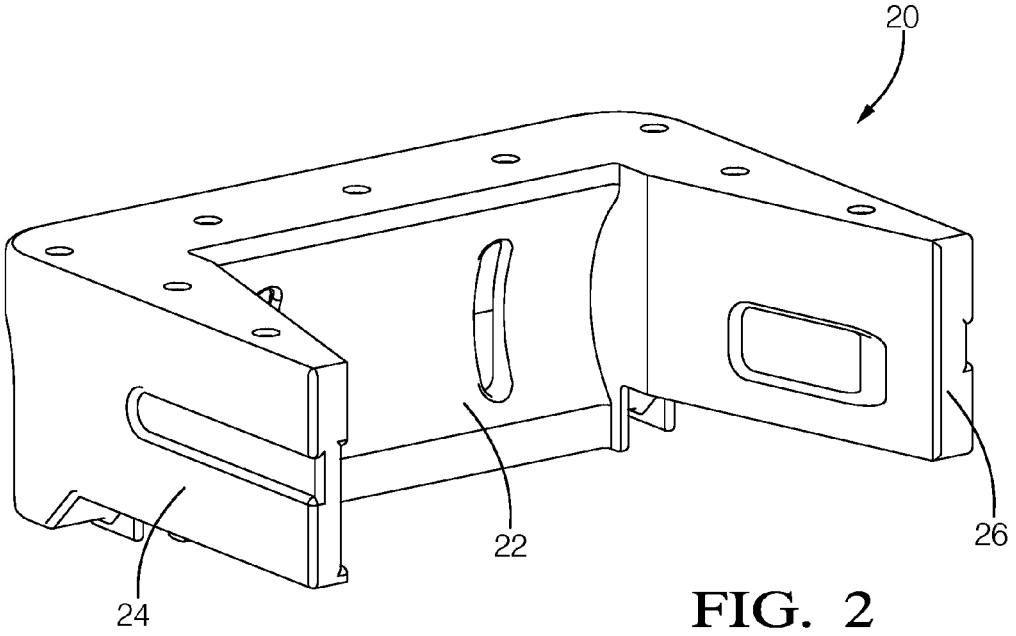
FIG. 2 is an isometric view of a high permeance structure of the ignition coil of FIG. 1.

Referring now to FIGS. 1 and 2, high permeance structure 20 is configured to provide a high permeance magnetic return path for the magnetic flux produced in core 18 during operation of ignition coil 10. High permeance structure 20 may be formed, for example, from a stack of silicon steel laminations or other adequate magnetic material. As described previously, high permeance structure 20 includes base section 22 and a pair of legs 24 and 26. Core 18 is positioned between legs 24 and 26 such that core longitudinal axis A passes through legs 24 and 26. One end of core 18 mates with leg 24 while the other end of core 18 forms a gap with leg 26 where the gap may be in a range of, for example only, about 0.5 mm to 2 mm.

Figure 3:
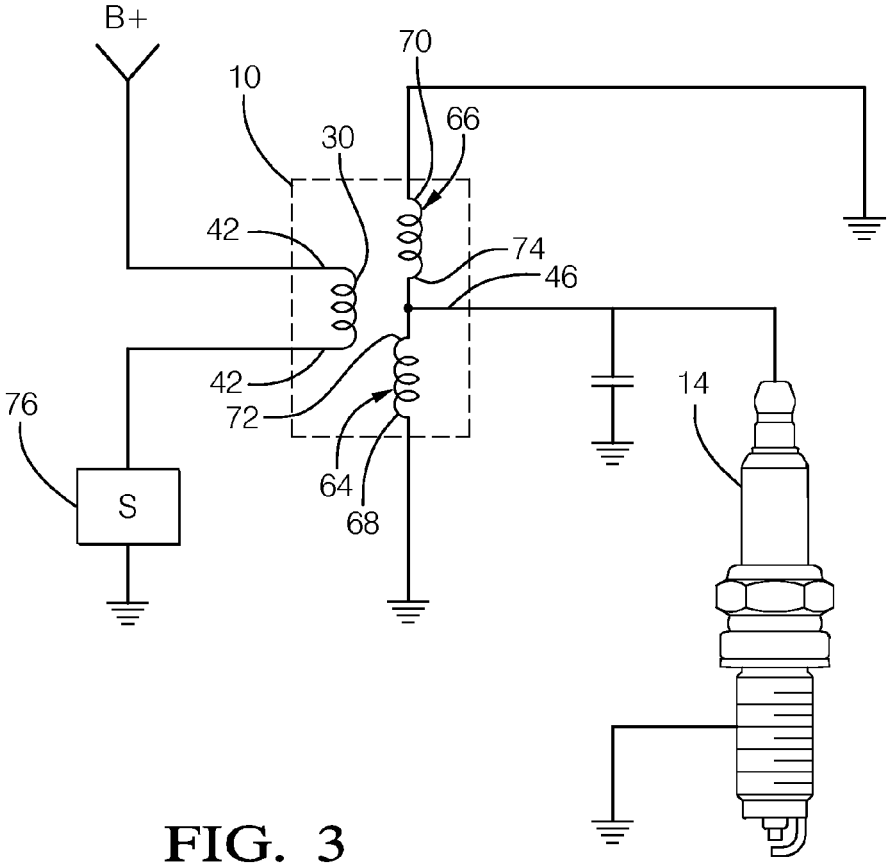
FIG. 3 is a simplified schematic and block diagram, in electrical form, of the ignition coil of FIG. 1.

With continued reference to FIG. 1, additional reference will now be made to FIG. 3 which is a simplified schematic and block diagram, in electrical form, of ignition coil 10 of FIG. 1. A switch 76 is provided for operation of ignition coil 10. Closing switch 76 establishes a path to ground through primary winding 30. When switch 76 is thereafter opened, the current through primary winding 30 is interrupted, thereby causing a relatively high voltage to be produced across left secondary winding section 64 and right secondary winding section 66. Since left secondary winding section 64 and right secondary winding section 66 have the same number of windings and are wound in opposite directions, the voltage at second end 72 of left secondary winding section 64 is substantially the same as the voltage at second end 74 of right secondary winding section 66, for example, about −30 kV. As described previously, left secondary winding section 64 and right secondary winding section 66 terminate within termination bay 61 and are connected to HV terminal 46 within termination bay 61. Consequently, the connection of left secondary winding section 64, right secondary winding section 66, and HV terminal 46 is between two areas of substantially equal voltage and there is substantially no potential difference at the connection to generate an area of electric field concentration. Furthermore, the height of ignition coil 10 is minimized since the high voltage ends of secondary winding 36, i.e. second end 72 of left secondary winding section 64 and second end 74 of right secondary winding section 66, terminate in the middle of secondary winding 36, thereby eliminating the need to route a high voltage end of secondary winding 36 axially along secondary winding 36.

While this invention has been described in terms of preferred embodiments thereof, it is not intended to be so limited, but rather only to the extent set forth in the claims that follow.

We claim:

1. An ignition coil for delivering a spark-generating current to a spark plug; said ignition coil comprising:

a magnetically-permeable core;

a primary winding disposed outward of said core; and a secondary winding disposed outward of said primary winding and inductively coupled to said primary winding, said secondary winding having a left secondary winding section wound clockwise around said primary winding and a right secondary winding section wound counterclockwise around said primary winding;

wherein said left secondary winding section has i) a first left winding end distal from said right secondary winding section and ii) a second left winding end that is proximal to said right secondary winding section, said second left winding end having a greater electrical potential in use than said first left winding end;

wherein said right secondary winding section has i) a first right winding end distal from said left secondary winding section and ii) a second right winding end that is proximal to said left secondary winding section, said second right winding end having a greater electrical potential in use than said first right winding end; and wherein said second left winding end and said second right winding end are connected to a terminal which delivers said spark-generating current to said spark plug.

2. An ignition coil as in claim 1 wherein said first left winding end of said left secondary winding section and said first right winding end of said right secondary winding section are connected to ground.

3. An ignition coil as in claim 2 further comprising a secondary spool with a left winding bay containing said left secondary winding section, a right winding bay containing said right secondary winding section, and a termination bay axially between the left winding bay and the right winding bay wherein:

said second left winding end terminates within said termination bay;

said second right winding end terminates within said termination bay; and said second left winding end and said second right winding end are connected to said terminal within said termination bay.

4. An ignition coil as in claim 2 wherein said second left winding end is elevated to a voltage that is substantially the same as said second right winding end.

5. An ignition coil as in claim 1 wherein said terminal is connected to said spark plug.

6. An ignition coil as in claim 5 wherein:

said terminal is between said spark plug and said second left winding end; and said terminal is between said spark plug and said second right winding end.

7. An ignition coil as in claim 1 wherein:

said second left winding end is between said spark plug and said first left winding end; and said second right winding end is between said spark plug and said first right winding end.

* * * * *